US007587315B2

(12) United States Patent
Unno

(10) Patent No.: US 7,587,315 B2
(45) Date of Patent: Sep. 8, 2009

(54) CONCEALMENT OF FRAME ERASURES AND METHOD

(75) Inventor: Takahiro Unno, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1749 days.

(21) Appl. No.: 10/085,548

(22) Filed: Feb. 27, 2002

(65) Prior Publication Data

US 2002/0123887 A1 Sep. 5, 2002

Related U.S. Application Data

(60) Provisional application No. 60/271,665, filed on Feb. 27, 2001.

(51) Int. Cl.
*G10L 19/12* (2006.01)
*G10L 21/02* (2006.01)

(52) U.S. Cl. ..... 704/223; 704/219; 704/220; 704/228

(58) Field of Classification Search ..... 704/1, 704/220, 222, 229, 228, 219, 223
See application file for complete search history.

(56) References Cited

U.S. PATENT DOCUMENTS

| | | | | |
|---|---|---|---|---|
| 5,699,485 | A * | 12/1997 | Shoham | 704/223 |
| 5,732,389 | A * | 3/1998 | Kroon et al. | 704/223 |
| 5,734,789 | A * | 3/1998 | Swaminathan et al. | 704/206 |
| 6,393,392 | B1 * | 5/2002 | Minde | 704/220 |
| 6,564,182 | B1 * | 5/2003 | Gao | 704/207 |
| 6,581,032 | B1 * | 6/2003 | Gao et al. | 704/222 |
| 6,810,377 | B1 * | 10/2004 | Ho et al. | 704/208 |
| 2002/0046021 | A1 * | 4/2002 | Cox et al. | 704/229 |
| 2003/0009325 | A1 * | 1/2003 | Kirchherr et al. | 704/211 |

FOREIGN PATENT DOCUMENTS

| | | |
|---|---|---|
| EP | 0773 630 | 5/1997 |

OTHER PUBLICATIONS

Watkins et al. Improving 16 KB/S G.728 LD-CELP Speech Coder For Frame Erasure Channels, 1995, International Conference on Acoustics, Speech, and Signal Processing, pp. 241-244.*

Martin et al. Improved Frame Erasure Concealment For CELP-Based Coders, 2000, Proceedings Acoustics, Speech, and Signal Processing, pp. 1483-1486.*

Husain A. et al; "Classification and Spectral Extrapolation Based Packet Reconstruction for Low-Delay Speech Coding"; Proccedings of the Global Telecommunications Conference; vol. 2., Nov. 28, 1994; pp. 848-852.

Combescure P et al.; "A 16, 24, 32 KBIT/S Wideband Speech Codec Based on ATCELP"; 1999 IEEE International Conference on Acoustics, Speech , and Signal Processing (ICASSP); vol. 1, Mar. 15-19, 1999; pp. 5-8.

De Martin J. C. et al; "Improved Frame Erasure Concealment for CELP-based Coders"; 2000 IEEE International Conference on Acoustics, Speech and Signal Processing Proceedings; Jun. 5-9, 2000; pp. 1483-1486, vol. 3.

* cited by examiner

*Primary Examiner*—Talivaldis Ivars Smits
*Assistant Examiner*—Thomas E. Shortledge
(74) *Attorney, Agent, or Firm*—Mima G. Abyad; Wade J. Brady, III; Frederick J. Telecky, Jr.

(57) ABSTRACT

A decoder for code excited LP encoded frames with both adaptive and fixed codebooks; erased frame concealment uses repetitive excitation plus a smoothing of pitch gain in the next good frame, plus multilevel voicing classification with multiple thresholds of correlations determining linear interpolated adaptive and fixed codebook excitation contributions.

6 Claims, 3 Drawing Sheets

CONCEALMENT OF FRAME ERASURES AND METHOD

CROSS-REFERENCE TO RELATED APPLICATIONS

This application claims priority from provisional application Ser. No. 60/271,665, filed Feb. 27, 2001 and pending application Ser. No. 09/705,356, filed Nov. 3, 2000.

BACKGROUND OF THE INVENTION

The invention relates to electronic devices, and more particularly to speech coding, transmission, storage, and decoding/synthesis methods and circuitry.

The performance of digital speech systems using low bit rates has become increasingly important with current and foreseeable digital communications. Both dedicated channel and packetized-over-network (e.g., Voice over IP or Voice over Packet) transmissions benefit from compression of speech signals. The widely-used linear prediction (LP) digital speech coding compression method models the vocal tract as a time-varying filter and a time-varying excitation of the filter to mimic human speech. Linear prediction analysis determines LP coefficients $a_i$, i=1, 2, . . . , M, for an input frame of digital speech samples {s(n)} by setting $$r(n)=s(n)+\Sigma_{M\geqq i\geqq 1}a_i s(n-i) \quad (1)$$

and minimizing the energy $\Sigma r(n)^2$ of the residual r(n) in the frame. Typically, M, the order of the linear prediction filter, is taken to be about 10-12; the sampling rate to form the samples s(n) is typically taken to be 8 kHz (the same as the public switched telephone network sampling for digital transmission); and the number of samples {s(n)} in a frame is typically 80 or 160 (10 or 20 ms frames). A frame of samples may be generated by various windowing operations applied to the input speech samples. The name "linear prediction" arises from the interpretation of $r(n)=s(n)+\Sigma_{M\geqq i\geqq 1}a_i s(n-i)$ as the error in predicting s(n) by the linear combination of preceding speech samples $-\Sigma_{M\geqq i\geqq 1}a_i s(n-i)$. Thus minimizing $\Sigma r(n)^2$ yields the $\{a_i\}$ which furnish the best linear prediction for the frame. The coefficients $\{a_i\}$ may be converted to line spectral frequencies (LSFs) for quantization and transmission or storage and converted to line spectral pairs (LSPs) for interpolation between subframes.

The {r(n)} is the LP residual for the frame, and ideally the LP residual would be the excitation for the synthesis filter 1/A(z) where A(z) is the transfer function of equation (1). Of course, the LP residual is not available at the decoder; thus the task of the encoder is to represent the LP residual so that the decoder can generate an excitation which emulates the LP residual from the encoded parameters. Physiologically, for voiced frames the excitation roughly has the form of a series of pulses at the pitch frequency, and for unvoiced frames the excitation roughly has the form of white noise.

The LP compression approach basically only transmits/stores updates for the (quantized) filter coefficients, the (quantized) residual (waveform or parameters such as pitch), and (quantized) gain(s). A receiver decodes the transmitted/stored items and regenerates the input speech with the same perceptual characteristics. Periodic updating of the quantized items requires fewer bits than direct representation of the speech signal, so a reasonable LP coder can operate at bits rates as low as 2-3 kb/s (kilobits per second).

However, high error rates in wireless transmission and large packet losses/delays for network transmissions demand that an LP decoder handle frames in which so many bits are corrupted that the frame is ignored (erased). To maintain speech quality and intelligibility for wireless or voice-over-packet applications in the case of erased frames, the decoder typically has methods to conceal such frame erasures, and such methods may be categorized as either interpolation-based or repetition-based. An interpolation-based concealment method exploits both future and past frame parameters to interpolate missing parameters. In general, interpolation-based methods provide better approximation of speech signals in missing frames than repetition-based methods which exploit only past frame parameters. In applications like wireless communications, the interpolation-based method has a cost of an additional delay to acquire the future frame. In Voice over Packet communications future frames are available from a playout buffer which compensates for arrival jitter of packets, and interpolation-based methods mainly increase the size of the playout buffer. Repetition-based concealment, which simply repeats or modifies the past frame parameters, finds use in several CELP-based speech coders including G.729, G.723.1, and GSM-EFR. The repetition-based concealment method in these coders does not introduce any additional delay or playout buffer size, but the performance of reconstructed speech with erased frames is poorer than that of the interpolation-based approach, especially in a high erased-frame ratio or bursty frame erasure environment.

In more detail, the ITU standard G.729 uses frames of 10 ms length (80 samples) divided into two 5-ms 40-sample subframes for better tracking of pitch and gain parameters plus reduced codebook search complexity. Each subframe has an excitation represented by an adaptive-codebook contribution and a fixed (algebraic) codebook contribution. The adaptive-codebook contribution provides periodicity in the excitation and is the product of v(n), the prior frame's excitation translated by the current frame's pitch lag in time and interpolated, multiplied by a gain, $g_P$. The fixed codebook contribution approximates the difference between the actual residual and the adaptive codebook contribution with a four-pulse vector, c(n), multiplied by a gain, $g_C$. Thus the excitation is $u(n)=g_P v(n)+g_C c(n)$ where v(n) comes from the prior (decoded) frame and $g_P$, $g_C$, and c(n) come from the transmitted parameters for the current frame. FIGS. 3-4 illustrate the encoding and decoding in block format; the postfilter essentially emphasizes any periodicity (e.g., vowels).

G.729 handles frame erasures by reconstruction based on previously received information; that is, repetition-based concealment. Namely, replace the missing excitation signal with one of similar characteristics, while gradually decaying its energy by using a voicing classifier based on the long-term prediction gain (which is computed as part of the long-term postfilter analysis). The long-term postfilter finds the long-term predictor for which the prediction gain is more than 3 dB by using a normalized correlation greater than 0.5 in the optimal (pitch) delay determination. For the error concealment process, a 10 ms frame is declared periodic if at least one 5 ms subframe has a long-term prediction gain of more than 3 dB. Otherwise the frame is declared nonperiodic. An erased frame inherits its class from the preceding (reconstructed) speech frame. Note that the voicing classification is continuously updated based on this reconstructed speech signal. FIG. 2 illustrates the decoder with concealment parameters. The specific steps taken for an erased frame are as follows:

1) repeat the synthesis filter parameters. The LP parameters of the last good frame are used.

2) repeat pitch delay. The pitch delay is based on the integer part of the pitch delay in the previous frame and is repeated for each successive frame. To avoid excessive periodicity, the pitch delay value is increased by one for each next subframe but bounded by 143.

3) repeat and attenuate adaptive and fixed-codebook gains. The adaptive-codebook gain is an attenuated version of the previous adaptive-codebook gain: if the $(m+1)^{st}$ frame is erased, use $g_P^{(m+1)}=0.9\ g_P^{(m)}$. Similarly, the fixed-codebook gain is an attenuated version of the previous fixed-codebook gain: $g_C^{(m+1)}=0.98\ g_C^{(m)}$.

4) attenuate the memory of the gain predictor. The gain predictor for the fixed-codebook gain uses the energy of the previously selected fixed codebook vectors c(n), so to avoid transitional effects once good frames are received, the memory of the gain predictor is updated with an attenuated version of the average codebook energy over four prior frames.

5) generate the replacement excitation. The excitation used depends upon the periodicity classification. If the last good or reconstructed frame was classified as periodic, the current frame is considered to be periodic as well. In that case only the adaptive codebook contribution is used, and the fixed-codebook contribution is set to zero. In contrast, if the last reconstructed frame was classified as nonperiodic, the current frame is considered to be nonperiodic as well, and the adaptive codebook contribution is set to zero. The fixed-codebook contribution is generated by randomly selecting a codebook index and sign index.

Leung et al, Voice Frame Reconstruction Methods for CELP Speech Coders in Digital Cellular and Wireless Communications, Proc. Wireless 93 (July 1993) describes missing frame reconstruction using parametric extrapolation and interpolation for a low complexity CELP coder using 4 subframes per frame.

However, the repetition-based concealment methods have poor results.

SUMMARY OF THE INVENTION

The present invention provides concealment of erased CELP-encoded frames with (1) repetition concealment but with interpolative re-estimation after a good frame arrives and/or (2) multilevel voicing classification to select excitations for concealment frames as various combinations of adaptive codebook and fixed codebook contributions.

This has advantages including improved performance for repetition-based concealment.

DETAILED DESCRIPTION OF THE PREFERRED EMBODIMENTS

1. Overview

Preferred embodiment decoders and methods for concealment of bad (erased or lost) frames in CELP-encoded speech or other signal transmissions mix repetition and interpolation features by (1) reconstruct a bad frame using repetition but re-estimating the reconstruction after arrival of a good frame and using the re-estimation to modify the good frame to smooth the transition and/or (2) use a frame voicing classification with three (or more) classes to provide three (or more) combinations of the adaptive and fixed codebook contributions for use as the excitation of a reconstructed frame.

Preferred embodiment systems (e.g., Voice over IP or Voice over Packet) incorporate preferred embodiment concealment methods in decoders.

Figure 3:
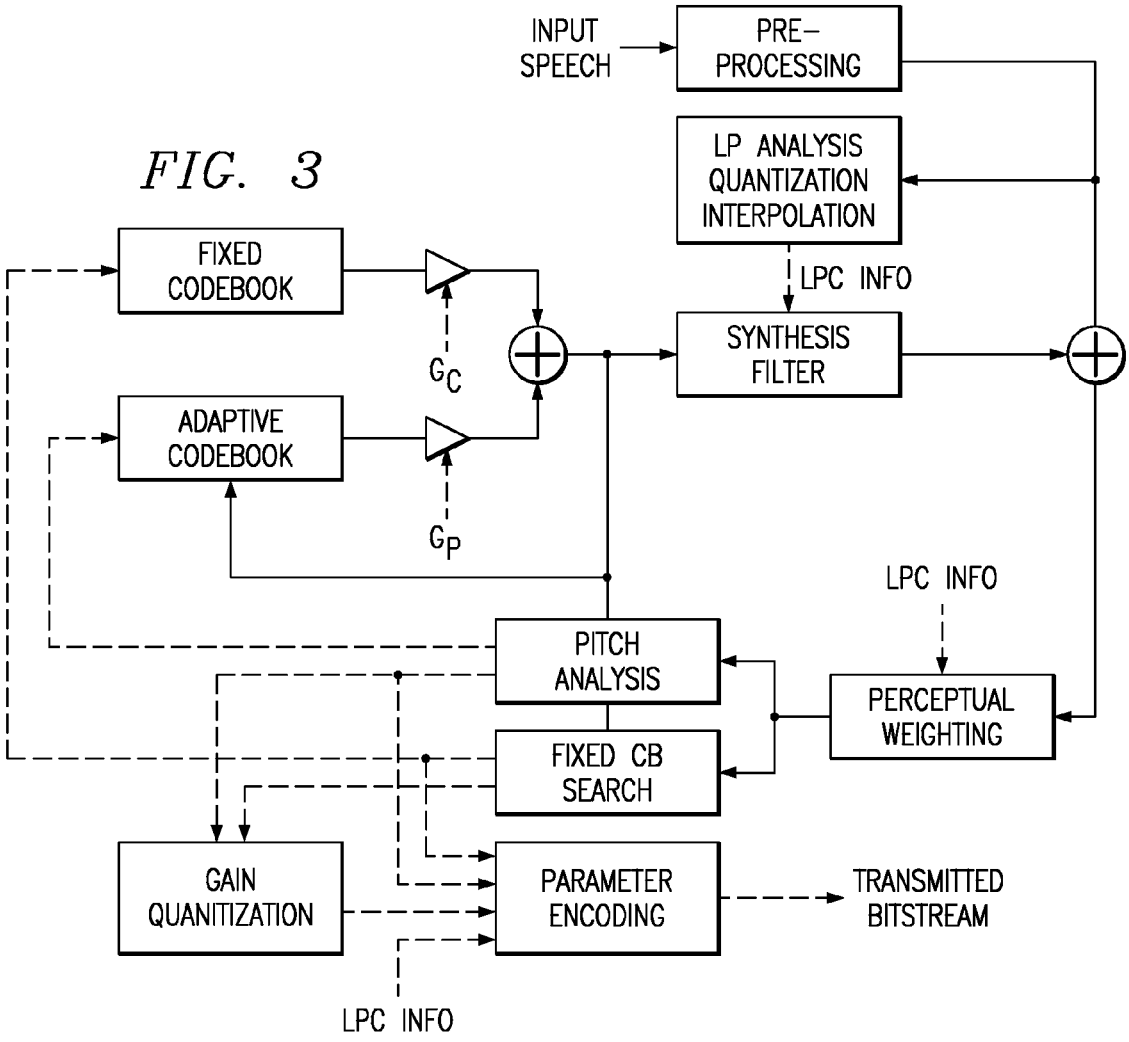
FIG. 3 is a block diagram of a known encoder.

2. Encoder Details some details of encoding methods similar to G.729 are needed to explain the preferred embodiments. In particular, FIG. 3 illustrates a speech encoder using LP encoding with excitation contributions from both adaptive and fixed codebook, and preferred embodiment concealment features affect the pitch delay, the codebook gains, and the LP synthesis filter. Encoding proceeds as follows:

(1) Sample an input speech signal (which may be preprocessed to filter out dc and low frequencies, etc.) at 8 kHz or 16 kHz to obtain a sequence of digital samples, s(n). Partition the sample stream into frames, such as 80 samples or 160 samples (e.g., 10 ms frames) or other convenient size. The analysis and encoding may use various size subframes of the frames or other intervals.

(2) For each frame (or subframes) apply linear prediction (LP) analysis to find LP (and thus LSF/LSP) coefficients and quantize the coefficients. In more detail, the LSFs are frequencies $\{f_1, f_2, f_3, \ldots f_N\}$ monotonically increasing between 0 and the Nyquist frequency (half the sampling frequency); that is, $0<f_1<f_2\ldots<f_M<f_{samp}/2$, and M is the order of the linear prediction filter, typically in the range 10-12. Quantize the LSFs for transmission/storage by vector quantizing the differences between the frequencies and fourth-order moving average predictions of the frequencies.

(3) For each (sub)frame find a pitch delay, $T_j$, by searching correlations of s(n) with s(n+k) in a windowed range; s(n) may be perceptually filtered prior to the search. The search may be in two stages: an open loop search using correlations of s(n) to find a pitch delay followed by a closed loop search to refine the pitch delay by interpolation from maximizations of the normalized inner product <x|y> of the target speech x(n) in the (sub)frame with the speech y(n) generated by the (sub)frame's quantized LP synthesis filter applied to the prior (sub)frame's excitation. The pitch delay resolution may be a fraction of a sample, especially for smaller pitch delays. The adaptive codebook vector v(n) is then the prior (sub)frame's excitation translated by the refined pitch delay and interpolated.

(4) Determine the adaptive codebook gain, $g_P$, as the ratio of the inner product <x|y> divided by <y|y> where x(n) is the target speech in the (sub)frame and y(n) is the (perceptually weighted) speech in the (sub)frame generated by the quantized LP synthesis filter applied to the adaptive codebook vector v(n) from step (3). Thus $g_P v(n)$ is the adaptive codebook contribution to the excitation and $g_P y(n)$ is the adaptive codebook contribution to the speech in the (sub)frame.

(5) For each (sub)frame find the fixed codebook vector c(n) by essentially maximizing the normalized correlation of quantized-LP-synthesis-filtered c(n) with $x(n)-g_P y(n)$ as the target speech in the (sub)frame; that is, remove the adaptive codebook contribution to have a new target. In particular, search over possible fixed codebook vectors c(n) to maximize the ratio of the square of the correlation $<x-g_P y|H|c>$ divided by the energy $<c|H^T H|c>$ where h(n) is the impulse response of the quantized LP synthesis filter (with perceptual filtering) and H is the lower triangular Toeplitz convolution matrix with diagonals h(0), h(1), . . . The vectors c(n) have 40 positions in the case of 40-sample (5 ms) (sub)frames being used as the encoding granularity, and the 40 samples are partitioned into four interleaved tracks with 1 pulse positioned within each track. Three of the tracks have 8 samples each and one track has 16 samples.

(6) Determine the fixed codebook gain, $g_C$, by minimizing $|x-g_P y-g_C z|$ where, as in the foregoing description, x(n) is the target speech in the (sub)frame, $g_P$ is the adaptive codebook gain, y(n) is the quantized LP synthesis filter applied to v(n), and z(n) is the signal in the frame generated by applying the quantized LP synthesis filter to the fixed codebook vector c(n).

(7) Quantize the gains $g_P$ and $g_C$ for insertion as part of the codeword; the fixed codebook gain may factored and predicted, and the gains may be jointly quantized with a vector quantization codebook. The excitation for the (sub)frame is then with quantized gains $u(n)=g_P v(n)+g_C c(n)$, and the excitation memory is updated for use with the next (sub)frame.

Note that all of the items quantized typically would be differential values with moving averages of the preceding frames' values used as predictors. That is, only the differences between the actual and the predicted values would be encoded.

The final codeword encoding the (sub)frame would include bits for: the quantized LSF coefficients, adaptive codebook pitch delay, fixed codebook vector, and the quantized adaptive codebook and fixed codebook gains.

3. Decoder Details

Figure 1:
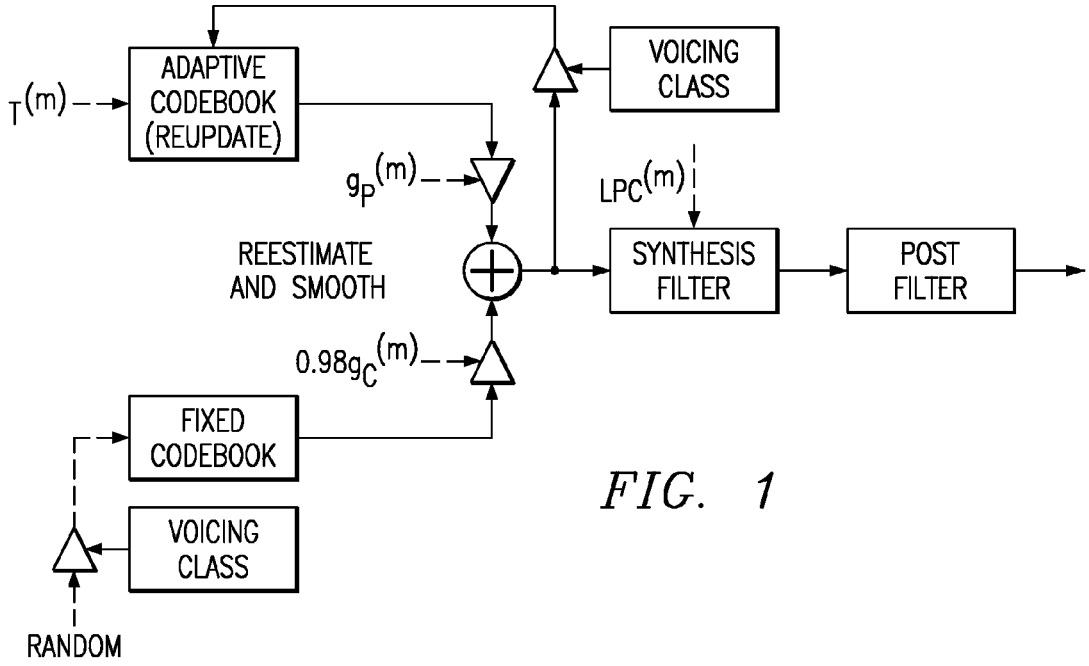
FIG. 1 shows preferred embodiments in block format.
Figure 2:
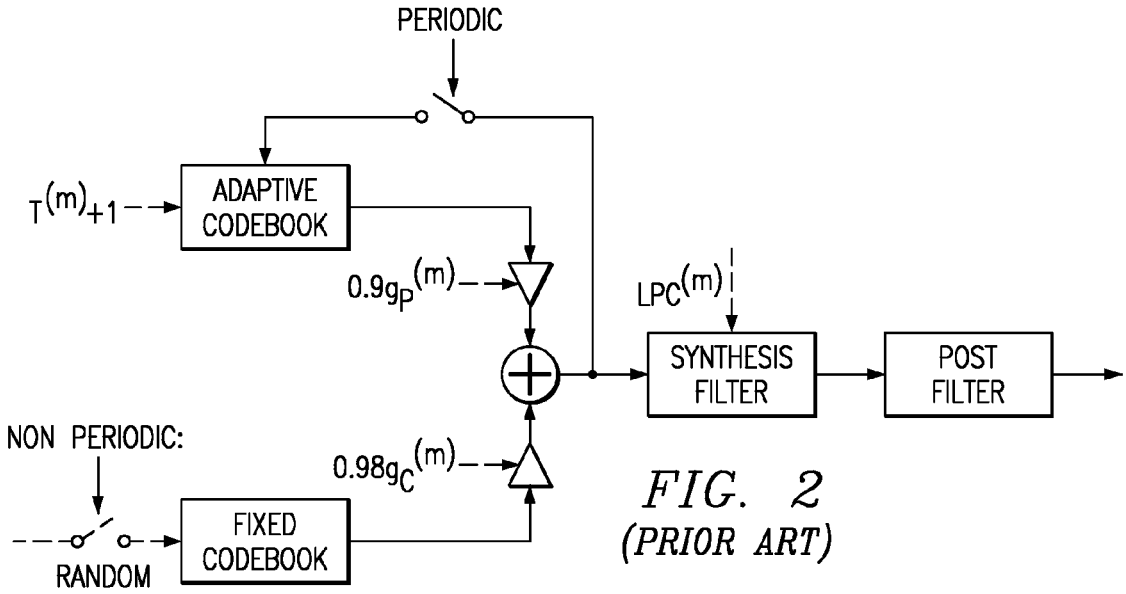
FIG. 2 (PRIOR ART)
FIG. 2 shows known decoder concealment.
Figure 4:
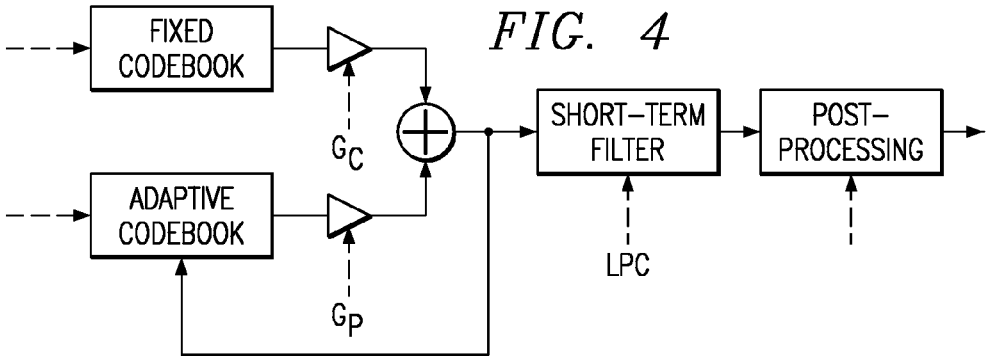
FIG. 4 is a block diagram of a known decoder.

Preferred embodiment decoders and decoding methods essentially reverse the encoding steps of the foregoing encoding method plus provide preferred embodiment repetition-based concealment features for erased frame reconstructions as described in the following sections. FIG. 4 shows a decoder without concealment features and FIG. 1 illustrates the concealment. Decoding for a good $m^{th}$ (sub)frame proceeds as follows:

(1) Decode the quantized LP coefficients $a_j^{(m)}$. The coefficients may be in differential LSP form, so a moving average of prior frames' decoded coefficients may be used. The LP coefficients may be interpolated every 20 samples (subframe) in the LSP domain to reduce switching artifacts.

(2) Decode the quantized pitch delay $T^{(m)}$, and apply (time translate plus interpolation) this pitch delay to the prior decoded (sub)frame's excitation $u^{(m-1)}(n)$ to form the adaptive-codebook vector $v^{(m)}(n)$; FIG. 4 shows this as a feedback loop.

(3) Decode the fixed codebook vector $c^{(m)}(n)$.

(4) Decode the quantized adaptive-codebook and fixed-codebook gains, $g_P^{(m)}$ and $g_C^{(m)}$. The fixed-codebook gain may be expressed as the product of a correction factor and a gain estimated from fixed-codebook vector energy.

(5) Form the excitation for the $m^{th}$ (sub)frame as $u^{(m)}(n)=g_P^{(m)}v^{(m)}(n)+g_C^{(m)}c^{(m)}(n)$ using the items from steps (2)-(4).

(6) Synthesize speech by applying the LP synthesis filter from step (1) to the excitation from step (5).

(7) Apply any post filtering and other shaping actions.

4. Preferred embodiment re-estimation correction

Preferred embodiment concealment methods apply a repetition method to reconstruct an erased/lost CELP frame, but when a subsequent good frame arrives some preferred embodiments re-estimate (by interpolation) the reconstructed frame's gains and excitation for use in the good frame's adaptive codebook contribution plus smooth the good frame's pitch gains. These preferred embodiments are first described for the case of an isolated erased/lost frame and then for a sequence of erased/lost frames.

First presume that the $m^{th}$ frame was a good frame and decoded, the $(m+1)^{st}$ frame was erased or lost and is to be reconstructed, and the $(m+2)^{nd}$ frame will be a good frame. Also, presume each frame consists of four subframes (e.g., four 5 ms subframes for each 20 ms frame). Then the preferred embodiment methods reconstruct an $(m+1)^{st}$ frame by a repetition method but after the good $(m+2)^{nd}$ frame arrives re-estimate and update with the following decoder steps:

(1) Define the LP synthesis filter for the $(m+1)^{st}$ frame $(1/\hat{A}(z))$ by taking the (quantized) filter coefficients $a_k^{(m+1)}$ to equal the coefficients $a_k^{(m)}$ decoded from the prior good $m^{th}$ frame.

(2) Define the adaptive codebook quantized pitch delays $T^{(m+1)}(i)$ for subframe i (i=1, 2, 3, 4) of the $(m+1)^{st}$ frame as each equal to $T^{(m)}(4)$, the pitch delay for the last (fourth) subframe of the prior good $m^{th}$ frame. As usual, apply the $T^{(m+1)}(1)$ pitch delay to $u^{(m)}(4)(n)$, the excitation of the last subframe of the $m^{th}$ frame to form the adaptive codebook vector $v^{(m+1)}(1)(n)$ for the first subframe of the reconstructed frame. Similarly, for subframe i, i=2, 3, 4, use the immediately prior subframe's excitation, $u^{(m+1)}(i-1)(n)$, with the $T^{(m+1)}(i)$ pitch delay to form adaptive codebook vector $v^{(m+1)}(i)(n)$.

(3) Define the fixed codebook vector $c^{(m+1)}(i)(n)$ for subframe i as a random vector of the type of $c^{(m)}(i)(n)$; e.g., four ±1 pulses out of 40 otherwise-zero components with one pulse on each of four interleaved tracks. An adaptive prefilter based on the pitch gain and pitch delay may be applied to the vector to enhance harmonic components.

(4) Define the quantized adaptive codebook (pitch) gain for subframe i (i=1, 2, 3, 4) of the $(m+1)^{th}$ frame, $g_P^{(m+1)}(i)$, as equal to the adaptive codebook gain of the last (fourth) subframe of the good $m^{th}$ frame, $g_P^{(m)}(4)$, but capped with a maximum of 1.0. This use of the unattenuated pitch gain for frame reconstruction maintains the smooth excitation energy trajectory. Similar to G.729, define the fixed codebook gains, $g_C^{(m+1)}(i)$, attenuating the previous fixed codebook gain by 0.98.

(5) Form the excitation for subframe i of the $(m+1)^{th}$ frame as $u^{(m+1)}(i)(n)=g_P^{(m+1)}(i)v^{(m+1)}(i)(n)+g_C^{(m+1)}(i)c^{(m+1)}(i)(n)$ using the items from foregoing steps (2)-(4). Of course, the excitation for subframe i, $u^{(m+1)}(i)(n)$, is used to generate the adaptive codebook vector, $v^{(m+1)}(i+1)(n)$, for subframe i+1 in step (2). Alternative repetition methods use a voicing classification of the $m^{th}$ frame to decide to use only the adaptive codebook contribution or the fixed codebook contribution to the excitation.

(6) Synthesize speech for the reconstructed frame m+1 by applying the LP synthesis filter from step (1) to the excitation from step (5) for each subframe.

(7) Apply any post filtering and other shaping actions to complete the repetition method reconstruction of the erased/lost $(m+1)^{st}$ frame.

(8) Upon arrival of the good $(m+2)^{nd}$ frame, the decoder checks whether the preceding bad (m+1) frame was an isolated bad frame (i.e., the m frame was good). If the (m+1) frame was an isolated bad frame, re-estimate the adaptive codebook (pitch) gains $g_P^{(m+1)}(i)$ from step (4) by linear interpolation using the pitch gains $g_P^{(m)}(i)$ and $g_P^{(m+2)}(i)$ of the two good frames bounding the reconstructed frame. In particular, set:

$$\check{g}_P^{(m+1)}(i)=[(4-i)G^{(m)}+iG^{(m+2)}]/4 \quad i=1, 2, 3, 4$$

where $G^{(m)}$ is the median of $\{g_P^{(m)}(2), g_P^{(m)}(3), g_P^{(m)}(4)\}$ and $G^{(m+2)}$ is the median of $\{g_P^{(m+2)}(1), g_P^{(m+2)}(2), g_P^{(m+2)}(3)\}$. That is, $G^{(m)}$ is the median of the pitch gains of the three subframes of the $m^{th}$ frame which are adjacent the reconstructed frame and similarly $G^{(m+2)}$ is the median of the pitch gains of the three subframes of the $(m+2)^{nd}$ frame which are adjacent the reconstructed frame. Of course, the interpolation could use other choices for $G^{(m)}$ and $G^{(m+2)}$, such as a weighted average of the gains of the two adjacent subframes.

(9) Re-update the adaptive codebook contributions to the excitations for the reconstructed (m+1) frame by replacing $g_P^{(m+1)}(i)$ with $\check{g}_P^{(m+1)}(i)$; that is, re-compute the excitations. This will modify the adaptive codebook vector, $v^{(m+2)}(1)(n)$, of the first subframe of the good $(m+2)^{th}$ frame.

(10) Apply a smoothing factor $g_S(i)$ to the decoded pitch gains $g_P^{(m+2)}(i)$ of the good (m+2) frame to yield modified pitch gains as:

$$g_{Pmod}^{(m+2)}(i)=g_S(i)g_P^{(m+2)}(i) \text{ for } i=1, 2, 3, 4$$

where the smoothing factor is a weighted product of the ratios of pitch gains and re-estimated pitch gains of the reconstructed subframes:

$$g_S(i)=[(g_P^{(m+1)}(1)/\check{g}_P^{(m+1)}(1))(g_P^{(m+1)}(2)/\check{g}_P^{(m+1)}(2))*$$

$$(g_P^{(m+1)}(3)/\check{g}_P^{(m+1)}(3))(g_P^{(m+1)}(4)/\check{g}_P^{(m+1)}(4))]^{w(i)} \text{ for } i=1, 2, 3, 4$$

where $g_P^{(m+1)}(k)=g_P^{(m)}(4)$ for k=1, 2, 3, 4 is the repeated pitch gain used for the reconstruction of step (4), and the weights are w(1)=0.4, w(2)=0.3, w(3)=0.2, and w(4)=0.1. Of course, other weights w(i) could be used. This smoothes any pitch gain discontinuity from the repeated pitch gain used in the reconstructed (m+1) frame to the decoded pitch gain of the good (m+2) frame. Note that the smoothing factor can be written more compactly as:

$$g_S(i)=[g_{rep}^{4}/\pi_{1\leq k\leq 4}\check{g}_P^{(m+1)}(k)]^{w(i)} \text{ for } i=1, 2, 3, 4$$

where $g_{rep}$ is the repeated pitch gain (i.e., $g_P^{(m)}(4)$) used for the repetition reconstruction of the (m+1) frame in step (4). Then replace $g_P^{(m+2)}(i)$ with $g_{Pmod}^{(m+2)}(i)$ for the decoding of the good $(m+2)^{th}$ frame; that is, take the excitation to be $u^{(m+2)}(i)(n)=g_{Pmod}^{(m+2)}(i)\, v^{(m+2)}(i)(n)+g_C^{(m+2)}(i)c^{(m+2)}(i)(n)$. Recall that the adaptive-codebook vector $v^{(m+2)}(1)(n)$ is based on the re-computed excitation of the reconstructed (m+1) frame in step (9).

As a simple example of this smoothing, consider the case of the decoded pitch gains in the subframes of the good $m^{th}$ frame are all equal $g_P^{(m)}$ and in the subfreams of the good $(m+2)^{th}$ frame are all equal $g_P^{(m+2)}$, then the $g_P^{(m+1)}(i)$ all repeat $g_P^{(m)}$ and the re-estimated pitch gains are $\check{g}_P^{(m+1)}(i)=[(4-i)g_P^{(m)}+ig_P^{(m+2)}]/4$ because the medians $G^{(m)}$ and $G^{(m+2)}$ are equal to $g_P^{(m)}$ and $g_P^{(m+2)}$, respectively. Hence, $1/g_S(i)=[((3+R)/4)((2+2R)/4)((1+3R)/4)R]^{w(i)}$ where R is the ratio $g_P^{(m+2)}/g_P^{(m)}$. Thus if the pitch gain is increasing, such as R=1.03, then $g_S(i)=0.9285^{w(i)}$, which translates into $g_S(1)=0.971$, $g_S(2)=0.978$, $g_S(3)=0.985$, and $g_S(4)=0.993$. (Note that as w(i) tends to 0, $g_S(i)$ tends to 1.000.) The smoothing changes the jump of pitch gain from $g_P^{(m)}$ to $g_P^{(m+2)(=}1.03\ g_P^{(m)})$ at the transition from subframe 4 of the reconstructed (m+1) frame to subframe 1 of the good (m+2) frame into a jump from $g_P^{(m)}$ to $0.971\ g_P^{(m+2)}=1.000\ g_P^{(m)}$; that is, no jump at all. And subframe 2 increases it to $1.007\ g_P^{(m)}$, subframe 3 increases it to $1.015\ g_P^{(m)}$, and subframe 4 increases it to $1.023\ g_P^{(m)}=0.993\ g_P^{(m+2)}$. Thus with smoothing the biggest jump between subframes is $0.008\ g_P^{(m)}$ rather than $0.03\ g_P^{(m)}$ without smoothing.

Lastly, the re-estimation $\check{g}_P^{(m+1)}(i)$ and re-computation of the excitations for the (m+1) frame can be performed without the smoothing $g_{Pmod}^{(m+2)}(i)$, and conversely, the smoothing can be performed without the re-computation of excitations.

Next, consider the case of more than one sequential bad frame. In particular, presume the $m^{th}$ frame was a good frame and decoded, the $(m+1)^{st}$ frame was erased or lost and is to be reconstructed as also are the $(m+2)^{nd}$, . . . , $(m+n)^{th}$ frames with the $(m+n+1)^{th}$ frame the next good frame. Again, presume each frame consists of four subframes (e.g., four 5 ms subframes for each 20 ms frame). Then the preferred embodiment methods successively reconstruct $(m+1)^{st}$ through $(m+n)^{th}$ frames using a repetition method but do not re-estimate or smooth after the good $(m+n+1)^{st}$ frame arrives with the following decoder steps:

(1') Use foregoing repetition method steps (1)-(7) to reconstruct the erased $(m+1)^{st}$ frame, then repeat steps (1)-(7) for the $(m+2)^{nd}$ frame, and so forth through repetition reconstruction of the $(m+n)^{th}$ frame as these frames arrived erased or fail to arrive. Note that the repetition method may have voicing classification to reduce the excitation to only the adaptive codebook contribution or only the fixed codebook contribution. Also, the repetition method may have attenuation of the pitch gain and the fixed-codebook gain as in G.729.

(2') Upon arrival of the good $(m+n+1)^{th}$ frame, the decoder checks whether the preceding bad (m+n) frame was an isolated bad frame. If not, the good $(m+n+1)^{th}$ frame is decoded as usual without any re-estimation or smoothing.

5. Alternative Preferred Embodiments with Re-Estimation

The prior preferred embodiments describe pitch gain re-estimation and smoothing for the case of four subframes per frame. In the case of two subframes per frame (e.g., two 5 ms subframes per 10 ms frame), the preceding preferred embodiment steps (1)-(7) are simply modified by the change from i=1, 2, 3, 4 to i=1,2 and the corresponding use of $g_P^{(m)}(2)$ in place of $g_P^{(m)}(4)$. However, the re-estimation of the pitch gains $g_P^{(m+1)}(i)$ from step (4) by linear interpolation as in steps (8)-(10) are revised so that:

$$\check{g}_P^{(m+1)}(i)=[(2-i)G^{(m)}+iG^{(m+2)}]/2 \quad i=1,2$$

where $G^{(m)}$ is just $g_P^{(m)}(2)$ and $G^{(m+2)}$ is just $g_P^{(m+2)}(1)$. That is, $G^{(m)}$ is the pitch gain of the subframe of the good $m^{th}$ frame which is adjacent the reconstructed frame and similarly $G^{(m+2)}$ is the pitch gain of the subframe of the good $(m+2)^{nd}$ frame which is adjacent the reconstructed frame.

similarly, the smoothing factor becomes $$g_S(i)=[(g_P^{(m+1)}(1)/\check{g}_P^{(m+1)}(1))(g_P^{(m+1)}(2)/\check{g}_P^{(m+1)}(2))]^{w(i)}$$

where w(1)=0.67 and w(2)=0.33.

Further, with only one subframe per frame (i.e., no subframes), then the re-estimation is $$\check{g}_P^{(m+1)}(1)=[G^{(m)}+G^{(m+2)}]/2$$

where $G^{(m)}$ is just $g_P^{(m)}(1)$ and $G^{(m+2)}$ is just $g_P^{(m+2)}(1)$. And the smoothing factor is:

$$g_S(1)=[g_P^{(m+1)}(1)/\check{g}_P^{(m+1)}(1)]^{w(1)}$$

where w(1)=1.0.

In the case of different numbers of subframes per frame, analogous interpolations and smoothings can be used.

6. Preferred Embodiment with Multilevel Periodicity (Voicing) Classification

Repetition methods for concealing erased/lost CELP frames may reconstruct an excitation based on a periodicity (e.g., voicing) classification of the prior good frame: if the prior frame was voiced, then only use the adaptive codebook contribution to the excitation, whereas for an unvoiced prior frame only use the fixed codebook contribution. Preferred embodiment reconstruction methods provide three or more voicing classes for the prior good frame with each class leading to a different linear combination of the adaptive and fixed codebook contributions for the excitation.

The first preferred embodiment reconstruction method uses the long-term prediction gain of the synthesized speech of the prior good frame as the periodicity classification measure. In particular, presume that the $m^{th}$ frame was a good frame and decoded and speech synthesized, and the $(m+1)^{st}$ frame was erased or lost and is to be reconstructed. Also, for clarity, ignore subframes although the same subframe treatment as in foregoing synthesis steps (1)-(7) may apply. First, as part of the post-filtering step of the synthesis for the $m^{th}$ frame (subsumed in step (7) of the foregoing synthesis) apply the analysis filter $\hat{A}(z/_{\gamma n})$ to the synthesized speech $\hat{s}(n)$ to yield a residual $\check{r}(n)$:

$$\check{r}(n)=\hat{s}(n)+\Sigma_{\hat{r}m}{}^{i}a_i^{(m)}\check{s}(n-i)$$

where the parameter $_{\gamma n}$=0.55 and the sum is over $1 \leqq i \leqq M$.

Next, find an integer pitch delay $T_0$ by searching about the integer part of the decoded pitch delay $T^{(m)}$ to maximize the correlation R(k) where the sum is over the samples in the (sub)frame:

$$R(k)=\Sigma_n\check{r}(n)\check{r}(n-k)$$

Then find a fractional pitch delay T by searching about $T_0$ to maximize the pseudo-normalized correlation R'(k):

$$R'(k)=\Sigma_n\check{r}(n)\check{r}_k(n)/\sqrt{(\Sigma_n\check{r}_k(n)\check{r}_k(n))}$$

where $\check{r}_k(n)$ is the residual signal at (interpolated fractional) delay k. Lastly, classify the $m^{th}$ frame as (a) strongly-voiced if $R'(T)^{2/}\Sigma_n\check{r}(n)\check{r}(n) \geqq 0.7$ (b) weakly-voiced if $0.7>R'(T)^{2/}\Sigma_n\check{r}(n)\check{r}(n) \geqq 0.4$ (c) unvoiced if $0.4>R'(T)^{2/}\Sigma_n\check{r}(n)\check{r}(n)$ This voicing classification of the $m^{th}$ frame will be used in step (5) of the reconstruction of the $(m+1)^{st}$ frame:

Proceed with the following steps for repetition reconstruction of the $(m+1)^{st}$frame:

(1) Define the LP synthesis filter for the $(m+1)^{st}$ frame $(1/\hat{A}(z))$ by taking the (quantized) filter coefficients $a_k^{(m+1)}$ to equal the coefficients $a_k^{(m)}$ decoded from the good $m^{th}$ frame.

(2) Define the adaptive codebook quantized pitch delays $T^{(m+1)}(i)$ for subframe i(i=1, 2, 3, 4) of the $(m+1)^{st}$ frame as each equal to $T^{(m)}(4)$, the pitch delay for the last (fourth) subframe of the prior good $m^{th}$ frame. As usual, apply the $T^{(m+1)}(1)$ pitch delay to $u^{(m)}(4)(n)$, the excitation of the last subframe of the $m^{th}$ frame to form the adaptive codebook vector $v^{(m+1)}(1)(n)$ for the first subframe of the reconstructed frame. Similarly, for subframe i, i=2,3,4, use the immediately prior subframe's excitation, $u^{(m+1)}(i-1)(n)$, with the $T^{(m+1)}(i)$ pitch delay to form adaptive codebook vector $v^{(m+1)}(i)(n)$.

(3) Define the fixed codebook vector $c^{(m+1)}(i)(n)$ for subframe i as a random vector of the type of $c^{(m)}(i)(n)$; e.g., four ±1 pulses out of 40 otherwise-zero components with one pulse on each of four interleaved tracks. An adaptive prefilter based on the pitch gain and pitch delay may be applied to the vector to enhance harmonic components.

(4) Define the quantized adaptive codebook (pitch) gain for subframe i (i=1, 2, 3, 4) of the $(m+1)^{th}$ frame, $g_P^{(m+1)}(i)$, as equal to the adaptive codebook gain of the last (fourth) subframe of the good $m^{th}$ frame, $g_P^{(m)}(4)$, but capped with a maximum of 1.0. This use of the unattenuated pitch gain for frame reconstruction maintains the smooth excitation energy trajectory. Similar to G.729, define the fixed codebook gains, attenuating the previous fixed codebook gain by 0.98.

(5) Form the excitation for subframe i of the $(m+1)^{th}$ frame as $u^{(m+1)}(i)(n)=\alpha g_P^{(m+1)}(i)v^{(m+1)}(i)(n)+\beta g_C^{(m+1)}(i)c^{(m+1)}(i)(n)$ using the items from foregoing steps (2)-(4) with the coefficients α and β determined by the previously-described voicing classification of the good $m^{th}$ frame:

(a) strongly-voiced: α=1.0 and β=0.0

(b) weakly-voiced: α=0.5 and β=0.5

(c) unvoiced: α=0.0 and β=1.0

Both α and β are in the range [0,1] with a increasing with increasing voicing and β decreasing. More generally, a general monotonic functional dependence of α and β on the periodicity (measured by $R'(T)^{2/}\Sigma_n\check{r}(n)\check{r}(n)$ or R'(T) or other periodicity measure) could be used such as $\alpha=[R'(T)^{2/}\Sigma_n\check{r}(n)\check{r}(n)]^2$ with cutoffs at 0 and 1.

(6) Synthesize speech for subframe i of the reconstructed frame m+1 by applying the LP synthesis filter from step (1) to the excitation from step (5).

(7) Apply any post filtering and other shaping actions to complete the reconstruction of the erased/lost $(m+1)^{st}$ frame.

subsequent bad frames are reconstructed by repetition of the foregoing steps with the same voicing classification. The gains may be attenuated.

7. Preferred Embodiment Re-Estimation with Multilevel Periodicity Classification Alternative preferred embodiment repetition methods for reconstruction of erased/lost frames combine the foregoing multilevel periodicity classification with the foregoing re-estimation repetition methods as illustrated in FIG. 1. In particular, perform the foregoing multilevel periodicity classification as part of the post-filtering for good frame m; next, follow steps (1)-(7) of foregoing repetition reconstruction with multilevel classification preferred embodiments for erased/lost frame (m+1) but with the following excitations defined in step (5):

(a) strongly-voiced: adaptive codebook contribution only (α=1.0, β=0)

(b) weakly-voiced: both adaptive and fixed codebook contributions (α=1.0, β=1.0)

(c) unvoiced: full fixed codebook contribution plus adaptive codebook contribution attenuated as in G.729 by 0.9 factor (α=1.0, β=1.0); this is equivalent to full fixed and adaptive codebook contributions without attenuation and α=0.9, β=1.0.

Then with the arrival of the $(m+2)^{nd}$ frame as a good frame, if the reconstructed (m+1) frame had its excitations defined either as a strongly-voiced or a weakly-voiced frame, then re-estimate the pitch gains and excitations plus smooth the pitch gains for the (m+2) frame as in steps (8)-(10) of the re-estimation preferred embodiments. Contrarily, if the reconstructed frame (m+1) had a unvoiced classification, then do not re-estimate and smooth in the (m+2) frame.

8. System Preferred Embodiments

Figure 5:
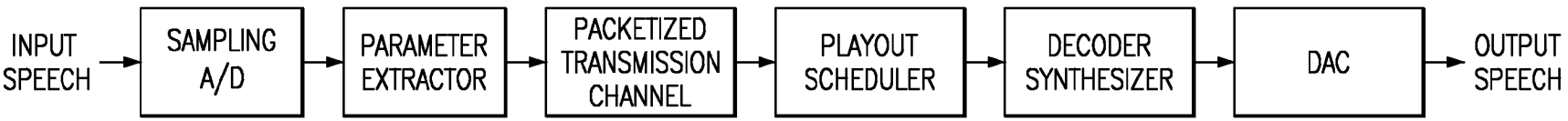
FIGS. 5-6 illustrate systems.
Figure 6:
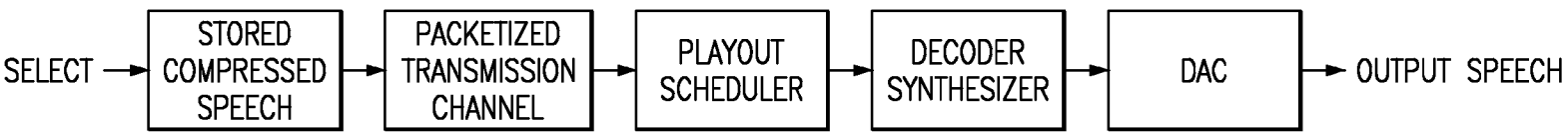

FIGS. 5-6 show in functional block form preferred embodiment systems which use the preferred embodiment encoding and decoding together with packetized transmission such as used over networks. Indeed, the loss of packets demands the use of methods such as the preferred embodiments concealment. This applies both to speech and also to other signals which can be effectively CELP coded. The encoding and decoding can be performed with digital signal processors (DSPs) or general purpose programmable processors or application specific circuitry or systems on a chip such as both a DSP and RISC processor on the same chip with the RISC processor controlling. Codebooks would be stored in memory at both the encoder and decoder, and a stored program in an onboard or external ROM, flash EEPROM, or ferroelectric memory for a DSP or programmable processor could perform the signal processing. Analog-to-digital converters and digital-to-analog converters provide coupling to the real world, and modulators and demodulators (plus antennas for air interfaces) provide coupling for transmission waveforms. The encoded speech can be packetized and transmitted over networks such as the Internet.

9. Modifications

The preferred embodiments may be modified in various ways while retaining one or more of the features of erased frame concealment in CELP compressed signals by re-estimation of a reconstructed frame parameters after arrival of a good frame, smoothing parameters of a good frame following a reconstructed frame, and multilevel periodicity (e.g., voicing) classification for multiple excitation combinations for frame reconstruction.

For example, numerical variations of: interval (frame and subframe) size and sampling rate; the number of subframes per frame, the gain attenuation factors, the exponential weights for the smoothing factor, the subframe gains and weights substituting for the subframe gains median, the periodicity classification correlation thresholds, . . .

What is claimed is:

1. A method for decoding code-excited linear prediction signals, comprising:

(a) forming an excitation for an erased interval of encoded code-excited linear prediction signals by a weighted sum of (i) an adaptive codebook contribution and (ii) a fixed codebook contribution, wherein said adaptive codebook contribution derives from an excitation and pitch and first gain of one or more intervals prior to said erased interval and said fixed codebook contribution derives from a second gain of at least one of said prior intervals;

(b) wherein said weighted sum has sets of weights depending upon a periodicity classification of at least one prior interval of encoded signals, said periodicity classification with at least three classes; and (c) filtering said excitation.

2. The method of claim 1, wherein:

(a) said filtering includes a synthesis with synthesis filter coefficients derived from filter coefficients of said intervals prior in time.

3. A decoder for CELP encoded signals, comprising:

(a) a fixed codebook vector decoder;

(b) a fixed codebook gain decoder;

(c) an adaptive codebook gain decoder;

(d) an adaptive codebook pitch delay decoder;

(e) an excitation generator coupled to said decoders; and (f) a synthesis filter;

(g) wherein when a received frame is erased, said decoders generate substitute outputs, said excitation generator generates a substitute excitation, said synthesis filter generates substitute filter coefficients, and said excitation generator uses a weighted sum of (i) an adaptive codebook contribution and (ii) a fixed codebook contribution with said weighted sum uses sets of weights depending upon a periodicity classification of at least one prior frame, said periodicity classification with at least three classes.

4. A method for decoding code-excited linear prediction signals, comprising:

(a) forming a reconstruction for an erased interval of encoded code-excited linear prediction signals by use parameters of one or more intervals prior to said erased interval;

(b) preliminarily decoding a second interval subsequent to said erased interval;

(c) combining the results of step (b) with said parameters of step (a) to form a reestimation of parameters for said erased interval; and (d) using the results of step (c) as part of an excitation for said second interval.

5. The method of claim 4, further comprising:

(a) said step (c) of claim 3 includes smoothing a gain.

6. A decoder for CELP encoded signals, comprising:

(a) a fixed codebook vector decoder;

(b) a fixed codebook gain decoder;

(c) an adaptive codebook gain decoder;

(d) an adaptive codebook pitch delay decoder;

(e) an excitation generator coupled to said decoders; and (f) a synthesis filter;

(g) wherein when a received frame is erased, said decoders generate substitute outputs, said excitation generator generates a substitute excitation, said synthesis fitter generates substitute filter coefficients, and when a second frame is received after said erased frame, said excitation generator combines parameters of said second frame with said substitute outputs to reestimate said substitute outputs to form an excitation for said second frame.

* * * * *

UNITED STATES PATENT AND TRADEMARK OFFICE

CERTIFICATE OF CORRECTION

PATENT NO. : 7,587,315 B2
APPLICATION NO. : 10/085548
DATED : September 8, 2009
INVENTOR(S) : Takahiro Unno It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2158 days.

Signed and Sealed this

Twenty-first Day of September, 2010

David J. Kappos

David J. Kappos
*Director of the United States Patent and Trademark Office*